US008616047B2

(12) United States Patent
Grunwald et al.

(10) Patent No.: US 8,616,047 B2
(45) Date of Patent: Dec. 31, 2013

(54) METHOD FOR THE ACTIVATION OF A TANK VENTING VALVE OF A MOTOR VEHICLE DURING A LEAK TEST

(75) Inventors: Oliver Grunwald, Hockenheim (DE); Wolfgang Ludwig, Butzbach-Maibach (DE); Matthias Wiese, Frankfurt am Main (DE)

(73) Assignee: Continental Automotive GmbH, Hannover (DE)

( * ) Notice: Subject to any disclaimer, the term of this patent is extended or adjusted under 35 U.S.C. 154(b) by 1150 days.

(21) Appl. No.: 11/338,162

(22) Filed: Jan. 24, 2006

(65) Prior Publication Data

US 2006/0162705 A1 Jul. 27, 2006

(30) Foreign Application Priority Data

Jan. 27, 2005 (DE) ..... 10 2005 003 924

(51) Int. Cl.
*G01M 3/32* (2006.01)
*G01M 3/18* (2006.01)
*G01M 3/26* (2006.01)

(52) U.S. Cl.
USPC ..... 73/47; 73/114.39; 73/49.7; 73/46; 123/516; 123/520; 123/521

(58) Field of Classification Search
USPC ..... 123/339.12, 339.23, 674, 494, 529, 123/295, 518–520, 516, 510–512; 73/47, 73/114.38–114.39, 114.52–114.54, 49.2
See application file for complete search history.

(56) References Cited

U.S. PATENT DOCUMENTS

| | | | | |
|---|---|---|---|---|
| 5,203,300 | A * | 4/1993 | Orzel | 123/339.12 |
| 5,463,998 | A | 11/1995 | Denz et al. | |
| 5,490,414 | A | 2/1996 | Dürschmidt et al. | |
| 5,611,316 | A * | 3/1997 | Oshima et al. | 123/494 |
| 6,276,343 | B1 * | 8/2001 | Kawamura et al. | 123/520 |
| 7,305,674 | B2 * | 12/2007 | Ditlow et al. | 718/100 |
| 2001/0032637 | A1 * | 10/2001 | Grieve et al. | 123/674 |

FOREIGN PATENT DOCUMENTS

| | | |
|---|---|---|
| DE | 42 03 100 A1 | 8/1993 |
| DE | 42 27 698 A1 | 2/1994 |
| DE | 197 13 085 A1 | 10/1998 |

* cited by examiner

*Primary Examiner* — Lindsay Low
*Assistant Examiner* — Kevin Lathers
(74) *Attorney, Agent, or Firm* — King & Spalding L.L.P.

(57) ABSTRACT

The invention relates to a method for regulating a fuel tank venting valve of a motor vehicle during leak testing of a fuel tank venting system where the fuel tank venting valve is arranged in a recovery line that connects a retention vessel to catch fuel vapors from a fuel tank to an inlet manifold of an operating internal combustion engine, comprising sealing the tank venting system from the atmosphere outside the motor vehicle, opening the fuel tank venting valve to expose the fuel tank and the tank venting system to a relative negative pressure present in the inlet manifold of the operating internal combustion engine and regulating the degree of opening of the tank venting valve based upon the external pressure, $p_A$.

9 Claims, 3 Drawing Sheets

METHOD FOR THE ACTIVATION OF A TANK VENTING VALVE OF A MOTOR VEHICLE DURING A LEAK TEST

CROSS REFERENCE TO RELATED APPLICATIONS

This application claims the benefits of German Patent application No. 10 2005 003 924.3 filed Jan. 27, 2005, all of the applications are incorporated by reference herein in their entirety

FIELD OF THE INVENTION

The invention relates to a method for the activation of a tank venting valve of a motor vehicle during leak testing of a tank venting system, the tank venting valve being arranged in a recovery line, which connects a retention vessel catching fuel vapors from a fuel tank to an inlet manifold of an internal combustion engine, and the tank venting system being sealed off airtightly from the atmosphere prevailing outside the motor vehicle and the tank venting valve being opened in order to build up a vacuum in the tank venting system and in the fuel tank connected to the retention vessel by way of a venting pipe, and closed again once a vacuum threshold has been reached.

BACKGROUND OF THE INVENTION

Such a method is disclosed by DE 197 13 085 A1 under the designations vacuum build-up testing and vacuum reduction testing. After opening of the tank venting valve, the vacuum prevailing in the inlet manifold ensures that the fuel-air mixture present in the tank venting system including the tank is sucked out, with the result that a vacuum builds up in the tank venting system. If the vacuum threshold is not reached within a predetermined length of time, this is already indicative of a leak in the tank venting system. In order to be able to roughly estimate the size of the leak, the attainment of a minimum pressure value in excess of the vacuum threshold is verified. If the minimum pressure value has not been attained, a medium-sized leak is inferred. If it was not even possible to attain the minimum pressure value, this is indicative of a major leak or the absence of a fuel filler cap. If the vacuum threshold was attained, the tank venting valve is closed again. In the case of a leak-tight tank venting system scarcely any pressure increase, if any, will be measurable. If a pressure increase occurs, however, which means that air or gas is getting into the system through a leak, the size of the leak is determined on the basis of the time curve for the pressure build-up, this being accomplished in DE 197 13 085 A1 by means of a physical model.

In the known method of vacuum build-up testing the tank venting valve is activated in such a way that the passage cross section of the recovery line is continuously increased up to a predefinable diagnostic value. The predefinable diagnostic value thereby serves for predefining a desired gas mass flow through the tank venting valve.

SUMMARY OF THE INVENTION

The invention is based on the finding that for the same tank filling level the quantity of a mixture of gassed-out fuel vapor and air present in the tank system and hence in the tank venting system varies as a function of the external pressure currently prevailing, that is the pressure of the external atmosphere surrounding the vehicle. Accordingly an activation of the tank venting valve based on the mass flow leads to vacuum build-up times of varying length. Any evaluation of the time curve for the vacuum build-up is therefore imprecise with regard to the presence of a leak.

The object of the present invention is to improve the accuracy of the known method for the leak testing of a tank venting system.

This object is achieved by a method according to the claims. According to the invention the degree of opening of the tank venting valve is adjusted as a function of the external pressure.

This ensures that for the same tank filling level and a leak-tight tank venting system a uniform vacuum build-up time can be adhered to. Should differences in the time taken to reach the vacuum threshold be measured during the vacuum build-up for the same tank filling level, these are definitely attributable to a leak. The method for leak testing of the tank venting system therefore functions more reliably.

The method according to the invention affords a further advantage when the quantity of fuel present in the tank, that is the tank filling level, is to be determined from the time it takes to reach a set vacuum threshold. Determination of the tank filling level is based on the consideration that with a lower filling level the volume of fuel vapor present above the liquid fuel is that much greater and it takes that much longer for the vacuum build-up to reach the vacuum threshold. The influence of the external pressure also has an effect on this, however, since owing to the simultaneous change in the vacuum build-up time any change in the external pressure would lead to a falsification of the tank filling level determined. The amount of deviation in the tank filling level determined varies with the change in the external pressure. The method according to the invention now makes it possible to completely exclude the influence of the external pressure on the vacuum build-up time and thereby to improve the accuracy of the tank filling level determined and to minimize the amount of deviation.

The matching of the degree of opening of the tank venting valve to the external pressure is embodied in two preferred alternative developments. In the first development, in a first step a degree of opening is selected as a function of a required gas mass flow through the tank venting valve and in a second step this is then corrected as a function of the external pressure. The second development represents an indirect method of influencing the degree of opening, since it does not focus on the actual degree of opening but on the gas mass flow through the tank venting valve that is set by the degree of opening, the gas mass flow flowing through the tank venting valve at a reference pressure being determined and corrected as a function of the external pressure, so that the gas mass flow actually flowing through the tank venting valve is determined from this.

The choice of alternative development, that is to say whether the degree of opening or the gas mass flow is corrected via the external pressure, is primarily determined by the existing embodiment of the leak testing for the tank venting system, relatively few changes to the existing method having to be made in either case.

In turn, two different approaches are proposed for correcting the degree of opening or the gas mass flow. Either a positive or negative offset to be added for the degree of opening or the gas mass flow is determined from the external pressure by means of a characteristics map, or a correction factor to be multiplied by the degree of opening or the gas mass flow is determined from the external pressure.

In a further development of the invention the external temperature, that is the temperature of the atmosphere outside the motor vehicle, is incorporated into the correction factor in addition to the external pressure.

In a special embodiment this correction factor is formed from the product of a normal temperature and the external pressure divided by the product of the external temperature and a normal pressure:

$$K = \frac{T_{norm} \cdot p}{T \cdot p_{norm}},$$

a. where:

b. $T_{norm}$=normal temperature, c. T=external temperature, d. p=external pressure, e. $p_{norm}$=normal pressure.

This correlation may be derived from the general gas equation. At a pressure p and a temperature T, the mass m of fuel-air gas present in the tank and in the tank venting system is determined from the equation $$m = \frac{V \cdot p}{R \cdot T}, \tag{2}$$

where V is the gas volume and R is the specific gas constant.

By way of simplification, it can be assumed here that during the leak test on the tank venting system the pressure p and the temperature T correspond directly to the external conditions, that is to the external pressure $p_A$ and to the external temperature $T_A$, since the tank venting system and hence also the tank are connected to the external atmosphere via a ventilation pipe. The connection is only interrupted for carrying out the leak test by the closure of a shut-off valve situated in the ventilation pipe.

With the tank venting valve closed, that is to say with the volume V constant, the mass m of the fuel-air gas accordingly varies only as a function of the quotient of the pressure p and the temperature T.

Under normal or reference conditions, that is to say at a normal pressure $p_{norm}$ and normal temperature $T_{norm}$, equation (2) gives a reference mass $m_{norm}$ in the tank system, which on opening of the tank venting valve leads to a gas mass flow through the valve of $$\dot{m}_{norm} = \frac{\Delta m_{norm}}{\Delta t},$$

the term $\Delta m_{norm}$ denoting the gas mass flowing through the tank venting valve during the vacuum build-up time $\Delta t$.

Even with a variable pressure and a variable temperature, the method according to the invention means that the vacuum build-up time $\Delta t$ is set to a constant value, that is $$\Delta t = \frac{\Delta m_{norm}}{\dot{m}_{norm}} = \frac{\Delta m}{\dot{m}} = konst.$$

At the associated temperature T and associated pressure p, any gas mass flow $\dot{m}$ through the tank venting valve is thereby given by the correlation:

$$\dot{m} = \dot{m}_{norm} \cdot \frac{T_{norm} \cdot p}{T \cdot p_{norm}} \tag{3}$$

For the external pressure $p_A$ and external temperature $T_A$ conditions prevailing during the leak test equation (3) thereby gives the correction factor $$K = \frac{T_{norm} \cdot p_A}{T_A \cdot p_{norm}},$$

by which a reference mass flow $\dot{m}_{norm}$ needs to be corrected in order to arrive at the gas mass flow $\dot{m}$ actually flowing through the tank venting valve.

The external pressure $p_A$ is measured either by a pressure sensor, the pressure sensor being either an absolute or a differential pressure sensor, or it is calculated by way of a model, into which another variable measured on the motor vehicle is fed. For example, the external pressure may be determined from the intake manifold pressure detected in the intake manifold, incorporating information on the current throttle valve position. Similarly, the external temperature $T_A$ is either measured as an absolute value or is calculated by way of a model. A temperature value measured in the intake line, for example, can be fed into such a temperature model.

BRIEF DESCRIPTION OF THE DRAWINGS

The invention will be explained in more detail below with reference to exemplary embodiments and to the drawing, in which:

- shows an internal combustion engine with fuel tank and tank venting system;
- shows the pressure curve in the tank venting system during the leak test;
- shows a block diagram for a correction of the degree of opening of the tank venting valve by way of a characteristics map;
- shows a block diagram for a correction of the degree of opening of the tank venting valve by way of a correction factor.

DETAILED DESCRIPTION OF THE INVENTION

Figure 1:
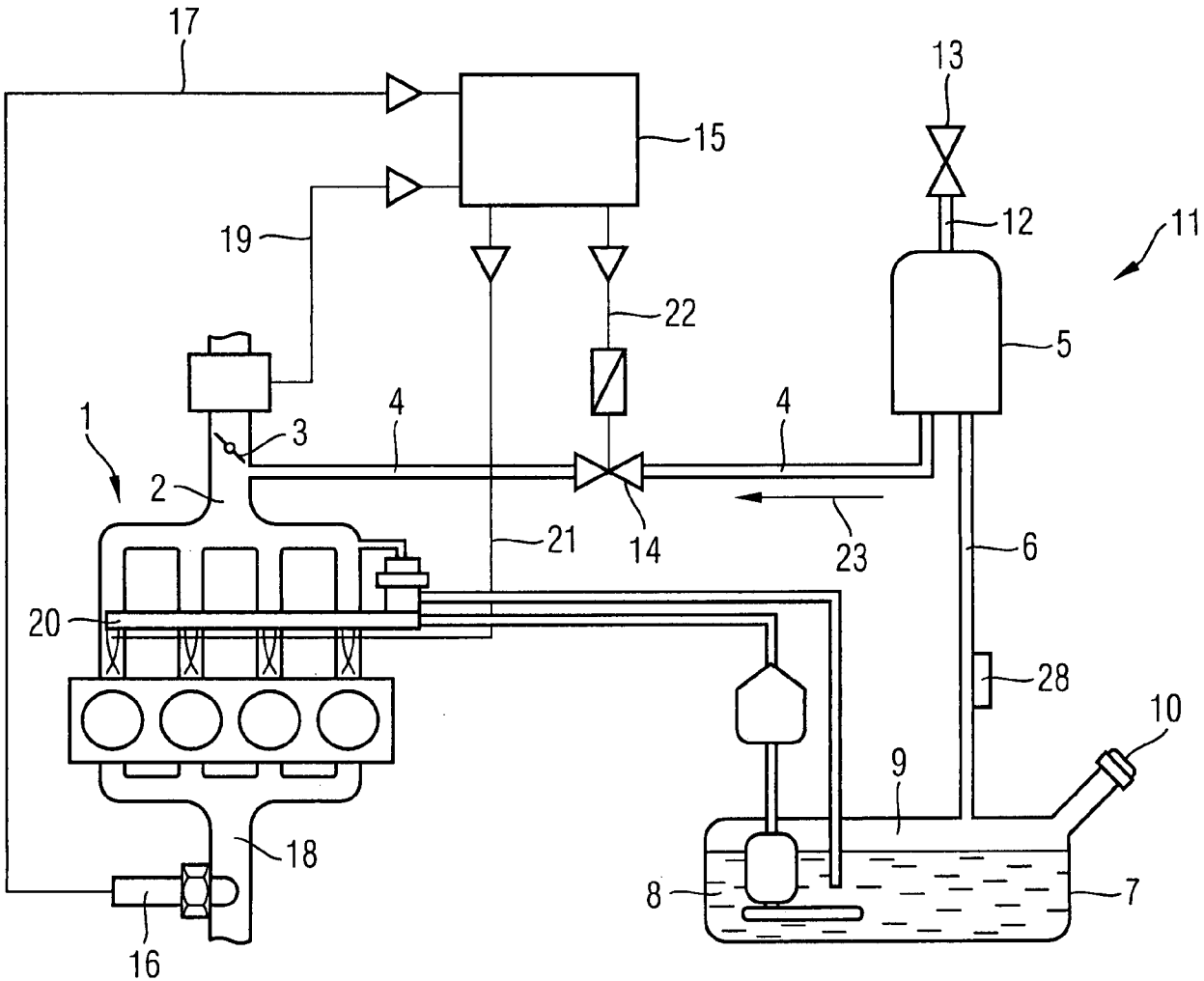

The motor vehicle internal combustion engine 1 represented in FIG. 1 has an intake manifold 2 in which a throttle valve 3 is situated. The intake manifold 2 is connected by way of a recovery line 4 to a retention vessel 5 of a tank venting system, and the retention vessel 5 is in turn connected by way of a venting pipe 6 to a fuel tank 7. The fuel gas 9 which has accumulated above the liquid fuel 8 situated in the fuel tank 7 passes via the venting pipe 6 into the retention vessel 5, where it is caught in an activated charcoal filter. The fuel tank 7 is closed by a fuel filler cap 10. The retention vessel 5 is connected to the external atmosphere 11 by a ventilation pipe 12. This connection may be interrupted by a shut-off valve 13. A tank venting valve 14 is arranged in the recovery line 4. Multiple sensor variables of the internal combustion engine, such as the air-fuel ratio 17 of the exhaust gas leaving the internal combustion engine via an exhaust system 18, which is measured by a lambda (λ) probe 16, together with the gas mass flow 19 of the aspirated air taken into the internal combustion engine 1 through the intake manifold 2, are delivered to an engine management module 15, in which among other things, an arithmetic and logic unit is situated. From these and other variables, such as the number of revolutions and the torque of the internal combustion engine 1, for example, the arithmetic and logic unit of the engine management module 15 determines various control variables for influencing the operation of the internal combustion engine 1, such as the injection time 21 for the delivery of fuel that is to be set on a fuel injection system 20. In addition, the arithmetic and logic unit of the engine management module 15 determines the degree of opening 22 of the tank venting valve 14.

For leak testing of the tank venting system, the shut-off valve 13 is closed, so that there is no longer any connection to the external atmosphere 11. The tank venting valve 14 is then opened, with the result that the vacuum prevailing in the intake manifold 2 spreads via the recovery line 4 and the venting pipe 6 into the tank venting system. Whilst the vacuum is building up, the fuel-air mixture present in the tank venting system flows through the tank venting valve 14 and produces a gas mass flow 23. Since this gas mass flow 23 varies as a function of the external pressure $p_A$ of the atmosphere 11 prevailing prior to closure of the shut-off valve 13, according to the invention, the arithmetic and logic unit of the engine management module takes account of the external pressure $p_A$ when calculating the degree of opening 22 of the tank venting valve 14. The external pressure $p_A$ is determined by the differential pressure sensor 28 arranged in the venting pipe 6 and is fed to the engine control module 15. Account can also be taken of the external temperature $T_A$ of the atmosphere 11. For this purpose, the external temperature $T_A$ is measured directly by a temperature sensor (not shown) and is likewise relayed to the engine control module 15.

Figure 2:
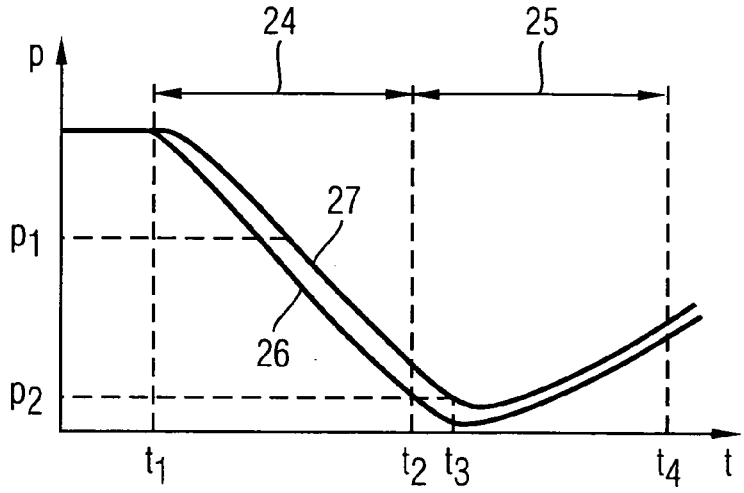

FIG. 2 shows the curve for the pressure p in the tank venting system during the leak test. As described in DE 197 13 085 A1, the leak test basically takes place in two stages: the vacuum build-up test 24 and the vacuum reduction test 25. Once the shut-off valve 13 has been closed, the tank venting valve 14 is opened at time $t_1$, and is closed again at time $t_2$, and the vacuum reduction test 25 commences. The leak test is completed at time $t_4$. The pressure p begins to fall, that is to say a vacuum builds up in the tank venting system at time $t_1$. The gradient of the vacuum build-up here varies as a function of the prevailing external pressure $p_A$. Two pressure curves are represented here, one curve 26 at lower external pressure $p_{A1}$ and one curve 27 at higher external pressure $p_{A2}$. At higher external pressure $p_{A2}$ a larger mass of fuel-air mixture has to be delivered through the tank venting valve 14, which takes correspondingly longer. At a lower external pressure $p_{A1}$ the pressure p reaches the vacuum threshold $p_2$ by time $t_2$, whereas at a higher external pressure $p_{A2}$ this only occurs at the later time $t_3$. Attainment of the vacuum threshold $p_2$ within a predetermined period of time is a prerequisite for carrying out the vacuum reduction test 25. In the example represented here the time $t_3$ already signifies a time overshoot, since the vacuum build-up test is already completed at time $t_2$, that is to say at higher external pressure the presence of a leak is here concluded erroneously. Likewise, should a leak actually be present, the size of the leak may be overestimated, since the minimum pressure value $p_1$ is also reached later, the minimum pressure value $p_1$ representing the threshold for the detection of a major leak or a missing fuel filler cap. In order to improve the accuracy of the vacuum build-up test 24, therefore, the degree of opening 22 of the tank venting valve 14 is adjusted so that a constant vacuum build-up time $t_2-t_1=t_3-t_1$=constant is set even in the event of a varying external pressure $p_A$.

Figure 3:
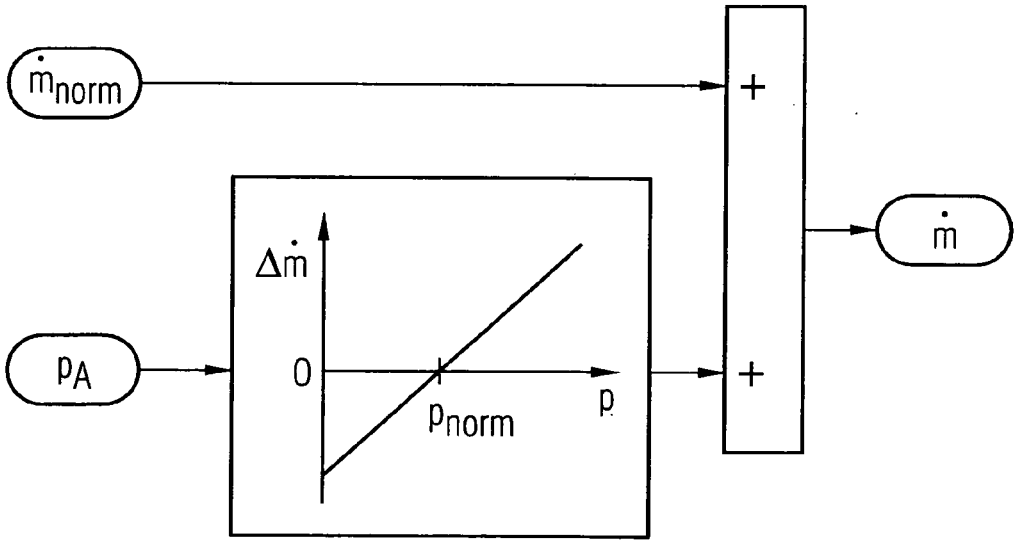

In a first exemplary embodiment according to FIG. 3 this is done by determining an offset from a characteristics map. From the various sensor variables, the arithmetic and logic unit of the engine management module 15, by way of formulae or characteristics curves, determines an assumed gas mass flow $\dot{m}_{norm}$ flowing through the tank venting valve 14, this gas mass flow being that which would occur under normal conditions $T_{norm}$ and $p_{norm}$. To correct this gas mass flow $\dot{m}_{norm}$, an offset $\Delta\dot{m}$ is determined, which is obtained from the external pressure $p_A$ actually prevailing. The offset $\Delta\dot{m}$ is added to the gas mass flow $\dot{m}_{norm}$, to give the gas mass flow $\dot{m}$ actually flowing through the tank venting valve 14. This gas mass flow $\dot{m}$ is then compared with a predetermined gas mass flow $\dot{m}_{soll}$, and the degree of opening 22 of the tank venting valve 14 is corrected until the predetermined gas mass flow is established, that is to say until $\dot{m}=\dot{m}_{soll}$.

The offset $\Delta\dot{m}$ is obtained from equation (3) assuming a prevailing external temperature of $T_A=T_{norm}$:

$$\dot{m} = \dot{m}_{norm} \cdot \frac{p}{p_{norm}} = \dot{m}_{norm} \cdot \frac{p_{norm} + \Delta p}{p_{norm}} \tag{4}$$

$$\dot{m} = \dot{m}_{norm} + \dot{m}_{norm} \frac{\Delta p}{p_{norm}} = \dot{m}_{norm} + \Delta\dot{m}$$

According to equation (4) the characteristic curve from FIG. 3 for determining the offset $\Delta\dot{m}$ is a straight line which, where the external pressure $p_A$ is equal to the normal pressure $p_{norm}$, results in an offset of zero.

Figure 4:
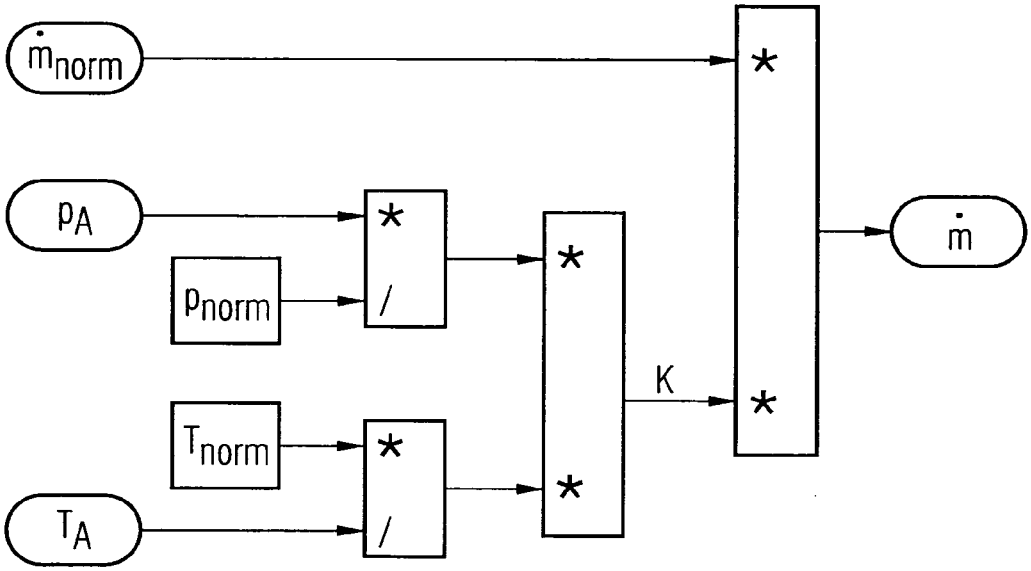

FIG. 4 shows a further example for the correction of the gas mass flow $\dot{m}_{norm}$ determined by the arithmetic and logic unit of the engine management module 15, the corrected gas mass flow $\dot{m}$ in this example also being brought into line with a predetermined gas mass flow $\dot{m}_{soll}$. In FIG. 4 the correction is performed as a function both of the external pressure $p_A$ and also of the external temperature $T_A$. The correction is performed in accordance with equation (3), in which the variables T and p have been replaced by $T_A$ and $p_A$:

$$\dot{m} = \dot{m}_{norm} \cdot \frac{T_{norm} \cdot p_A}{T_A \cdot p_{norm}} = \dot{m}_{norm} \cdot K \tag{5}$$

In other words, the external pressure $p_A$, the external temperature $T_A$ and the reference variables $p_{norm}$ and $T_{norm}$ set as constants are combined to form the correction factor K and this is multiplied by the gas mass flow $\dot{m}_{norm}$ applying under normal conditions.

The invention claimed is:

1. A method of regulating a fuel tank venting valve of a motor vehicle during leak testing of a fuel tank venting system where the fuel tank venting valve is arranged in a recovery line that connects a retention vessel to catch fuel vapors from a fuel tank to an inlet manifold of an operating internal combustion engine, comprising:

sealing the tank venting system from the atmosphere outside the motor vehicle;

opening the fuel tank venting valve to expose the fuel tank and the tank venting system to a relative negative pressure present in the inlet manifold of the operating internal combustion engine; and regulating the degree of opening of the tank venting valve at least in part as a function of a calculated gas mass flow, $\dot{m}_{soll}$, through the valve, wherein the gas mass flow, $\dot{m}_{soll}$, is calculated based at least in part upon a nominal gas mass flow, $\dot{m}_{norm}$, and a reference pressure, $p_{norm}$, and then corrected as a function of the external ambient pressure, $p_A$, and;

monitoring a duration of time required to reach a predetermined vacuum threshold in the fuel tank venting system.

2. The method of regulating a fuel tank venting valve as claimed in claim 1, further comprising closing the fuel tank venting valve when a predetermined relative negative pressure has been achieved.

3. The method of regulating a fuel tank venting valve as claimed in claim 1, further comprising partially opening the fuel tank venting valve prior to regulating the degree of opening.

4. The method of regulating a fuel tank venting valve as claimed in claim 1, wherein a correction factor, K, representative of the degree of opening of the nominal gas mass flow, $\dot{m}_{norm}$, is determined from the external pressure, $p_A$.

5. The method of regulating a fuel tank venting valve as claimed in claim 4, wherein external temperature, $T_A$, is additionally incorporated into the correction factor, K.

6. The method of regulating a fuel tank venting valve as claimed in claim 5, wherein the correction factor, K, is determined as the product of a nominal temperature, $T_{norm}$, and the external pressure, $P_A$, divided by the product of the external temperature, $T_A$, and a nominal pressure, $P_{norm}$, $$K = \frac{T_A * P_A}{T_A * P_{norm}}.$$

7. A method of regulating a fuel tank venting valve of a motor vehicle during leak testing of a fuel tank venting system where the fuel tank venting valve is arranged in a recovery line that connects a retention vessel to catch fuel vapors from a fuel tank to an inlet manifold of an operating internal combustion engine, comprising:

sealing the tank venting system from the atmosphere outside the motor vehicle;

opening the fuel tank venting valve to expose the fuel tank and the tank venting system to a relative negative pressure present in the inlet manifold of the operating internal combustion engine; and regulating the degree of opening of the tank venting valve based upon a function depending at least in part on the external ambient pressure outside of the motor vehicle, $p_A$, and a gas mass flow, $\dot{m}_{soll}$, through the valve, wherein an offset value, $\Delta\dot{m}$, for regulating the fuel tank vent valve or for the correction of the nominal gas mass flow, $\dot{m}_{norm}$, is determined from a characteristic map which uses the external ambient pressure ($p_A$) as an input, and wherein the regulation of the fuel tank venting valve improves the fuel system leak test accuracy.

8. The method of regulating a fuel tank venting valve as claimed in claim 7, wherein the external pressure, $p_A$, is measured by a differential or absolute pressure sensor.

9. The method of regulating a fuel tank venting valve as claimed in claim 7, wherein the external pressure, $p_A$, is calculated by a mathematical model that is formed from a plurality of measured variables of the motor vehicle.

* * * * *